United States Patent [19]

Tyree, Jr.

[11] 4,127,008

[45] Nov. 28, 1978

[54] METHOD AND APPARATUS FOR COOLING MATERIAL USING LIQUID $CO_2$

[76] Inventor: Lewis Tyree, Jr., 145 Briarwood Ave., North, Oak Brook, Ill. 60521

[21] Appl. No.: 737,440

[22] Filed: Nov. 1, 1976

[51] Int. Cl.[2] ..... F25D 25/00; F25D 3/12

[52] U.S. Cl. ..... 62/62; 62/46; 62/165; 62/332; 62/514 R

[58] Field of Search ..... 62/45, 46, 47, 48, 55, 62/165, 332, 384, 514 R, 62, 63, 380

[56] References Cited

U.S. PATENT DOCUMENTS

| | | | |
|---|---|---|---|
| 3,754,407 | 8/1973 | Tyree, Jr. | 62/514 R |
| 3,802,212 | 4/1974 | Martin et al. | 62/514 R |
| 3,810,365 | 5/1974 | Hampton et al. | 62/48 |
| 3,984,993 | 10/1976 | Muska | 62/45 |
| 3,994,141 | 11/1976 | Schräwer | 62/514 R |

*Primary Examiner*—Ronald C. Capossela

*Attorney, Agent, or Firm*—Fitch, Even, Tabin & Luedeka

[57] ABSTRACT

Apparatus for supplying a refrigeration system with a low-temperature liquid $CO_2$. High pressure liquid $CO_2$ is supplied from a storage vessel system to a holding chamber where the pressure is reduced to create vapor and $CO_2$ snow, forming a low-temperature coolant reservoir. Vapor is removed from the chamber to maintain the pressure therein at about 75 p.s.i.a. or below by a compressor and returned to the storage vessel. The stored cooling power of the reservoir is then employed to meet refrigeration demand and is thereafter replenished over a period of hours. The storage principle can be incorporated into a variety of different systems. For example, additional liquid $CO_2$ may be supplied from the storage vessel to a refrigeration system wherein vapor is created that is transferred to the holding chamber for condensation by melting the snow.

24 Claims, 5 Drawing Figures

METHOD AND APPARATUS FOR COOLING MATERIAL USING LIQUID $CO_2$

The present invention relates to carbon dioxide refrigeration and more particularly to systems for providing a relatively large quantity of refrigeration on an intermittent basis with minimum expenditure of carbon dioxide.

There are many small and intermittent users of freezing equipment, particularly in the food industry where food products are prepared in batches, and to preserve their taste, texture, visual appeal and the like, these products should be quickly frozen. Such food processors include specialty bakers, caterers, commissaries and chefs in large restaurants and hotels, where preparation may take several hours and result in a relatively large batch of product which the processor will then wish to quick-freeze at one time. In general, mechanical freezers are not economically suitable for such intermittent, relatively large-scale, fast-freezing operations, which require a relatively low temperature environment, for example, −30° F. or −40° F., because a large capital investment would be needed as well as provision for a high short-term power need. Cryogenic fast-freezing can be of significant benefit to such users, and examples of cryogenic freezing units are set forth in my prior U.S. Pat. Nos. 3,660,985, 3,672,181, 3,754,407 and 3,815,377. However, heretofore, cryogenic freezing systems have generally accommodated such an intermittent high-level requirement by the expenditure of a substantial amount of cryogen, and this fact has diminished the attractiveness of cryogenic freezing for such potential users.

In addition to the foregoing, there are many other situations requiring refrigeration on a generally cyclic basis where there will be periods of heavy usage, followed by periods of much lower usage or periods where there is no need at all for refrigeration. The adaptation of cryogenic refrigeration systems to serve such systems to provide a commercially attractive alternative to available systems existing today is desired.

It is an object of the present invention to provide a carbon dioxide cooling system which can supply a relatively large quantity of coolant capacity intermittently on an economically attractive basis. Another object of the invention is to provide an improved method for carbon dioxide cryogenic freezing that is capable of handling intermittent, relatively large batches of product on an efficient and economically attractive basis. A further object of the invention is to provide a carbon dioxide cooling system which requires a relatively low capital expenditure and has relatively low peak power and cryogen usage requirements, but which is capable of intermittently supplying a large quantity of refrigeration when needed. Still another object is to provide a system which can provide cryogenic cooling without expenditure of cryogen and which can significantly reduce the capital cost because it is capable of providing three or more times as much refrigeration capacity, compared to a standard system using compressors and condensers of similar size.

These and other objects of the invention will be apparent from the following detailed description of the preferred embodiments of the invention when read in conjunction with the accompanying drawings wherein.

Very generally, it has been found that an arrangement can be provided for supplying a relatively large amount of refrigeration at cryogenic temperatures on an intermittent basis, by establishing a low-temperature coolant reservoir of carbon dioxide slush or snow. This reservoir can be economically created during a time period when there is low usage or at night or during other "off" periods. Accordingly, the build-up of refrigeration capacity in the reservoir can be accomplished relatively slowly, requiring only fairly low power demands and requiring relatively small capacity equipment. Thus, a relatively large reservoir of carbon dioxide slush or snow can be created using only a relatively small compressor and condenser to recover the vapor so long as there is a sufficient length of time for the compressor and condenser to operate.

When the need for refrigeration arises, cold liquid carbon dioxide can be supplied at the necessary rate, while taking advantage of the immediate availability of cooling capacity of the low-temperature reservoir to assist the compressor in recovering the vapor that will be generated. The latent heat absorption capacity of the solid $CO_2$ is available for cooling, either directly or indirectly by condensing $CO_2$ vapor. As a result, sufficient cooling capacity can be stored in the reservoir to effect, for example, fast freezing of a large amount of product in a relatively short period of time while recovering the vaporized cryogen for reuse. When a period of peak use is followed by one of no or only low usage, operation of a relatively low capacity compressor is effective to regenerate the low-temperature coolant reservoir for another freezing cycle. The sizing of reservoirs, compressors and condensers is arranged as desired for different cycles, and more than a single unit may be employed in a system when design conditions so dictate.

Figures 1, 2, 3:
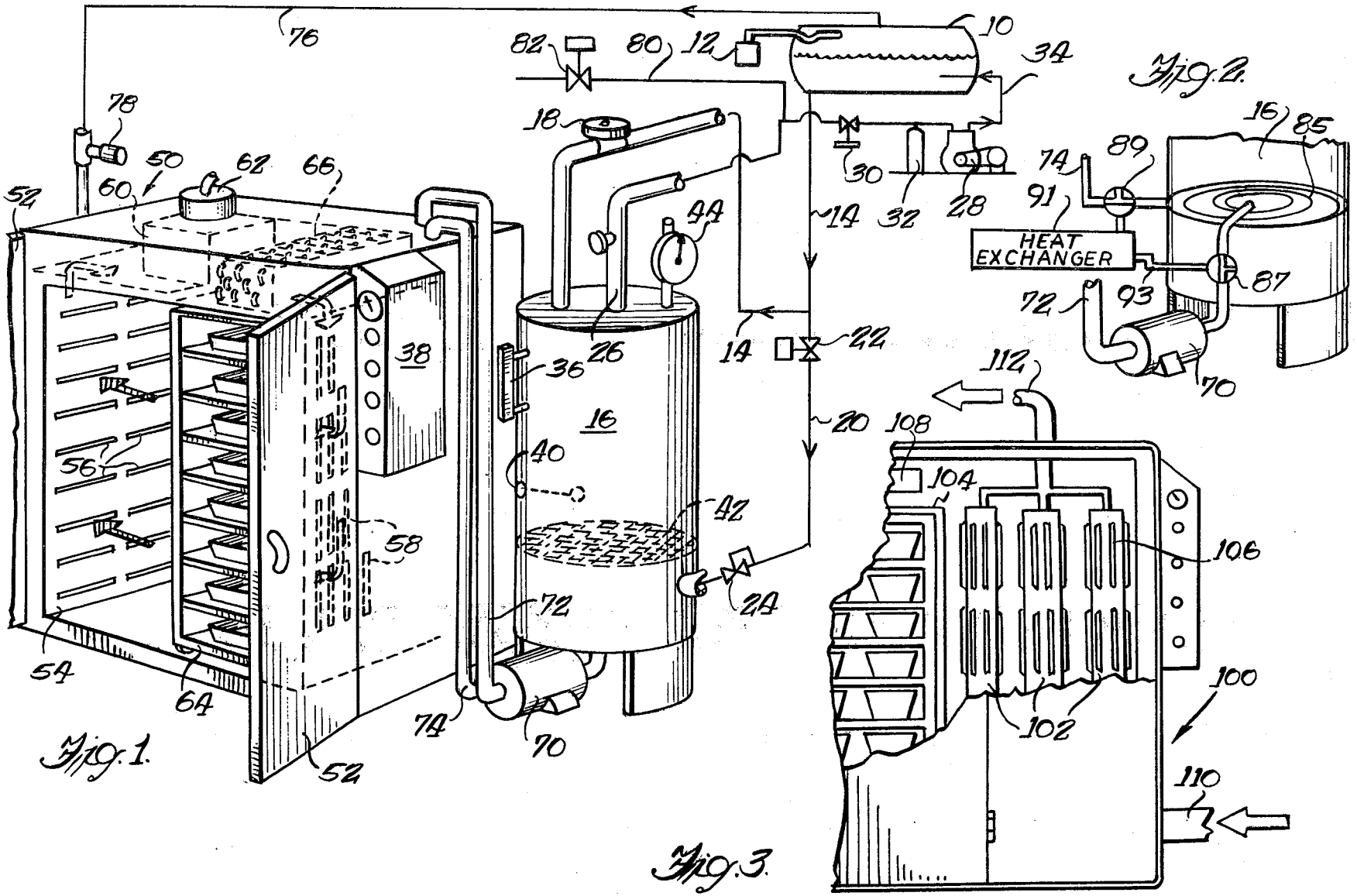
FIG. 1 is a diagrammatic view of a carbon dioxide cooling system embodying various features of the invention.
FIG. 2 is a fragmentary view of an alternative arrangement for a portion of the system illustrated in FIG. 1.
FIG. 3 is a view similar to FIG. 2 of still another alternative arrangement.

One arrangement for providing intermittent cooling to a specialty food service operation or the like, which embodies certain features of the invention, is depicted in FIG. 1. A standard carbon dioxide liquid storage vessel 10 is employed which is designed for the storage of liquid carbon dioxide at about 300 p.s.i.g., at which pressure it will have an equilibrium temperature of about 0° F. A refrigeration unit 12, such as a freon condenser, is associated with the storage vessel 10 and is designed to operate as needed to condense carbon dioxide vapor in the vessel to liquid. The freon condenser is a standard item, and one is employed with a sufficient condensation capacity to match the size of the tank and the intended operation for utilization of the liquid carbon dioxide. A typical condenser for an installation of this type may be rated to condense about 50 pounds of carbon dioxide vapor an hour at 300 p.s.i.g.

A liquid line 14 extends from the bottom of the storage vessel 10 to an upper portion of a chamber or holding tank 16 via a remotely operable valve 18. If desirable because of the length of piping run from the storage vessel, a pump (not shown) may be included in the liquid line 14. A branch line 20 is connected to the liquid line 14, and it enters at a lower location on the tank 16 via a remote-controlled valve 22 and a pressure regulator 24. The pressure regulator assures that the pressure in the line does not drop below about 80 p.s.i.a.

A vapor line 26 extends from the upper portion of the tank 16 to the intake side of a compressor 28. Connected in the vapor line 26 are a remotely-operable valve 30 and an accumulator 32, which are used for a purpose to be explained hereinafter. A line 34 extends from the discharge of the compressor 28 to a location near the bottom of the interior of the storage vessel 10 so that the warmed, high pressure gas is bubbled into the liquid carbon dioxide in the storage vessel. In this manner, the body of liquid carbon dioxide acts as a thermal flywheel or "de-superheater," and the freon refrigeration unit 12 is utilized to carry out the reliquification of the high pressure vapor.

The holding tank 16 is equipped with a liquid level control 36 which is electrically linked to a remote control panel 38. Once the desired liquid level within the tank 16 is reached, the control circuitry operates to cause the valve 18 to close. The compressor 28 can run, if desired, during filling to remove vapor from the tank 16 in order to reduce the pressure of the liquid $CO_2$ from the initial high pressure at which it was supplied from the storage tank (e.g., 300 p.s.i.g.) to at least as low as about 75 p.s.i.a. and preferably to below about 70 p.s.i.a. Lowering the pressure results in vaporization, cooling the unvaporized liquid $CO_2$, and dropping the temperature of the liquid carbon dioxide in the holding tank.

The liquid level within the holding tank 16 of course continuously decreases as a result of the vaporization that occurs, and if it reaches a lower level as set by the controller 36, a signal to the control system 38 would cause the valve 18 to open and supply additional liquid $CO_2$ from the storage tank 10 into the tank through the upper line 14 so long as the pressure in the tank as measured by the monitor 44 is above a preset value, e.g., 75 p.s.i.a. Some of the liquid being supplied will immediately vaporize, subcooling the remainder, and filling continues until the desired liquid level is reached.

When the temperature reaches about −69° F., solid $CO_2$ begins to form as vaporization continues. In actuality a layer of solid $CO_2$ is formed near the surface of the liquid in the tank; however, the density of solid $CO_2$ is greater than that of liquid $CO_2$ so it has a tendency to sink. By interrupting the suction which the compressor is exerting on the tank, vaporization is momentarily halted, and such a pause allows the solid $CO_2$ layer to sink below the surface. Resumption of the suction by the compressor 28 then results in the formation of another solid layer, and subsequent interruption allows this layer to sink. Such repeated sucking and interrupting causes a reservoir of slush to be built up within the holding tank 16.

Although the compressor 28 could be stopped and started to create these interruptions, only a momentary interruption, for example, about fifteen seconds is needed; and this can be more expediently accomplished by closing the valve 30 in the vapor line and allowing the compressor to suck on the empty chamber 32 which thus serves as a suction accumulator. Accordingly, the control system is set so as to begin these interruptions after a predetermined temperature or pressure is reached in the reservoir within the tank, as monitored by a temperature sensor 40 or a pressure gauge and monitor 44, but of course the actual times would be dependent upon the size of the compressor and of the slush tank. For example, once about −69° F. or 75 p.s.i.a. is reached, which is indicative that solid $CO_2$ is beginning to be formed, the control system 38 interrupts the suction of the compressor on the holding tank by closing the valve 30 for about fifteen seconds after every three or four minutes of operation. This action results in the repeated formation of relatively thin layers of solid $CO_2$ which repeatedly sink down in the holding tank 16 until reaching the level of a screen 42, which is located a slight distance above the tank bottom.

Once slush-making has begun so that the compressor is maintaining the pressure below 75 p.s.i.a., and the lower level of liquid in the tank is reached so that the level controller 36 calls for more liquid the control system 38 may be set so as to allow no further liquid input or a limited further amount. If it is decided to supply further liquid $CO_2$, the valve 22 leading to the branch line 20 is opened to fill the tank from the bottom and assure good mixing of the warmer liquid occurs. The liquid $CO_2$ entering the tank through the branch line 20 passes through the pressure regulator 24, the purpose of which is to prevent any solid $CO_2$ formation upstream in the region of the valve 22. By filling the tank 16 via the bottom line 20, there is no need to interrupt the slushing process.

The repetition of these operations builds up a low-temperature reservoir of carbon dioxide slush coolant in the tank 16 which is then available for cooling or freezing needs. Ideally, the system is sized so that the region of the tank above the screen 42 becomes substantially filled with slush to the desired level during the rest period when the user is preparing the food products to be frozen. If there should be some delay in the preparation of the products, the control system 38 is designed to detect the conditions indicating achievement of the desired level of slush and halt the operation of the compressor before the entire reservoir is transformed to solid $CO_2$. One set of conditions which might be so indicative would be monitoring a temperature of about −70° F. while the liquid level shows a substantially full condition; under these conditions when the pressure within the tank, as read by the monitor 44, also decreases below about 70 p.s.i.a., it is an indication of formation of a fairly thick solid $CO_2$ layer at the top of the reservoir, in which instance vaporization should be halted by shutting down the compressor.

Once the low-temperature reservoir has been established, use can be made of it in several different ways in effecting the freezing of the product, depending upon the choice of system the customer or user selects. Several alternatives are illustrated and described hereinafter. In the embodiment illustrated in FIG. 1, a refrigeration enclosure is provided in the form of a freezer cabinet 50 having a pair of outwardly swinging insulated front doors 52. The cabinet 50 has a layer of thermal insulation, for example, polyurethane foam, lining the interior of rear and side walls and the top and bottom, and it is provided with inner liner 54 that defines the enclosure wherein the product is placed that is to be frozen.

The liner 54 has a plurality of horizontally extending exit slots 56 in one wall and a plurality of vertically extending entrance slots 58 in the opposite wall through which a circulation of gas can be effected. The liner 54 is appropriately spaced from the insulated side walls and top walls of the cabinet 50 so as to provide a plenum chamber or passageway system through which a flow of air or gas can be continuously circulated by a fan or blower 60 which is driven by an electric motor 62 mounted atop the cabinet. The illustrated enclosure is designed to accommodate a pair of wheeled carts 64 carrying racks of food products which have just been prepared and are ready for quick freezing. The control panel 38 is conveniently located in a box mounted on the side of the refrigerator cabinet 50.

Cooling of the enclosure within the confines of the insulated outer walls is effected by an extended surface heat exchanger 66 that is located between the insulated top of the cabinet and the upper wall of the liner. The blower 60 causes the atmosphere within the enclosure to be drawn outward through the horizontal exit slots 56 up to the fan, whence it is pushed through the extended surface of the heat exchanger 66, where it is cooled, then down through the passageway outside the opposite wall returning to the enclosure via the vertical slots 58 and finally horizontally across the refrigeration enclosure, thereby cooling the food products carried by the carts.

In the embodiment shown in FIG. 1, low temperature liquid $CO_2$ is withdrawn from the bottom of the holding tank 16 and pumped by a suitable pump 70 through the heat exchanger 66 via the insulated line 72. After flowing throughout the length of the tubing which constitutes the liquid side of the heat exchanger, it exits the refrigeration cabinet 50 via the insulated line 74 and is returned to the tank at a location just below the screen 42. As a result, the −60° F. to −70° F. liquid $CO_2$ being pumped through the tubing which carries the extended surface of the heat exchanger 66 is at least partially vaporized, as it takes up heat from the gaseous atmosphere being circulated therepast by the blower 60.

As the warm fluid mixture returns through the line 74 to the holding tank 16, it is caused to enter near the bottom so that it will mix with the cold slush as it attempts to rise in the tank, condensing the vapor and lowering the temperature of the warmed liquid $CO_2$ to the temperature of the slush reservoir, i.e., about −70° F. As a result, the refrigeration system is capable of being able to fairly promptly circulate a gaseous atmosphere at about −60° F. across the food products to be frozen. Thus, the advantages of cryogenic freezing are obtained within the refrigeration enclosure without expending carbon dioxide and exhausting it to the atmosphere. The heat given up by the warmer returning liquid $CO_2$ and the condensing vapor is absorbed by the latent heat of the solid $CO_2$ portion of the slush as it melts to form liquid $CO_2$. Thus, the previously established, low-temperature slush reservoir provides a large amount of ready cooling at cryogenic temperatures to effect fast-freezing of a batch of product.

Usually, the control system 38 will be set so as to actuate the compressor 28 (if it is not already operating) as soon as the product to be frozen is loaded into the refrigeration cabinet 50, the doors 52 locked shut, and the blower motor 62 and pump 70 begin to run. In this manner, the compressor 28 will be working to continue to create additional low temperature liquid $CO_2$ while refrigeration is being carried out within the cabinet 50. Should the product itself be at all susceptible to flavor deterioration by oxidation or should even faster freezing be desired, a vapor connection between the cabinet 50 and the storage vessel 10 is made via the line 76. In this situation, before the control system actuates the blower motor 62, a valve 78 in the line 76 is automatically opened to flood the enclosure with carbon dioxide vapor which substantially displaces the air therefrom. The freezing process is then carried out using the denser (compared to air) carbon dioxide vapor which has excellent heat capacity characteristics, as well as preventing flavor deterioration. Should the special effects of another gas be desired, it could be introduced into the enclosure instead of the $CO_2$ vapor from the tank 10.

The system is designed to provide cryogenic freezing temperatures under conditions which allow recovery of substantially all of the carbon dioxide vapor, while at the same time requiring only minimal capital requirements because use is made of both a relatively low horsepower compressor and condenser. However, the system is not limited to operation in this manner, and if additional cooling capacity is needed, as for example, if on a particular day the user wishes to freeze more than the normal amount of product so that the period during which the low temperature slush reservoir is regenerated must be cut short, such freezing can be accomplished. A vent line 80 from the holding tank 16 is provided which is equipped with a remotely operable valve 82 that can be opened via the control panel. Accordingly, should the reservoir in the tank rise above a pre-set temperature, e.g., −60° F., or a pre-set pressure, e.g., about 95 p.s.i.a., during a time period when the pump 70 is pumping liquid carbon dioxide and the compressor 28 is operating, the control system 38 will sense that the low-temperature coolant reservoir has been substantially depleted and that the compressor 28 alone is unable to keep up with the demand for freezing capacity. Under these circumstances, the valve 82 will be opened to vent carbon dioxide vapor from the holding tank 16 so as to quickly lower the pressure within the tank and thus return the liquid reservoir to its desired low temperature. Although the carbon dioxide vapor thus vented is not recoverable, the amount vented should constitute only a very minor portion of the total amount of $CO_2$ vapor handled by the system and condensed, and operation in this manner allows the system to achieve freezing even beyond its rated capacity, which can be a very valuable asset to a user when greater than a normal amount of freezing is needed on a particular day.

In the modified embodiment depicted in FIG. 2, the screen is removed from the lower portion of the holding tank 16, and a coil of heat-exchange tubing 85 is disposed in the tank. One end of the coil 85 is connected to the suction end of the liquid pump 70 which discharges to the supply line to the heat-exchanger 66 in the refrigeration cabinet 50, and the other end of the coil 85 is connected to the return line 74 from the heat-exchanger. Instead of pumping the liquid carbon dioxide from the holding tank 16 through the heat-exchanger 66 and back, a suitable, low-temperature, heat-exchange liquid is pumped in a closed circuit through the coil 85 and through the tube side of the extended surface heat-exchanger 66. This arrangement does not allow quite as low a temperature to be achieved in the refrigeration cabinet, as the system shown in FIG. 1, because of the inherent temperature drop across the coil 85; however, temperatures approaching −55° F. can be attained in the refrigeration enclosure, which is adequate for most fast-freezing operations.

An advantage which accompanies the use of such an ancillary heat-exchange liquid is the facilitation of including suitable valving in the circuit to defrost the heat-exchanger 66 if needed. Appropriate 3-way valves 87 and 89 can be installed in the supply line 72 and the return line 74 to isolate the coil 85 in the holding tank from the pump 70. Actuation of the 3-way valves 87,89 causes the pump 70 to circulate the heat-exchange liquid through an ambient air heat-exchanger 91 which is located in a branch line 93. Thus, during the rest period when the coolant reservoir is being reestablished, if frost has built-up on the heat-exchanger 66, the heat-exchange liquid can be circulated through the extended-surface heat-exchanger 66 and through the ambient air heat-exchanger 91, and defrosting of the heat-exchanger in the refrigeration cabinet 50 can be simply effected without interfering with the cryogenic portion of the overall system.

In the second alternative embodiment depicted in FIG. 3, the holding tank or chamber is incorporated into the design of the extended surface heat-exchanger in a refrigeration cabinet 100. A plurality of large diameter tubes 102 are located in the region just to the right of the freezing enclosure defined by a liner 104 as viewed in FIG. 3. Each of the tubes 102 carries a plurality of axially extending, spiral heat-exchange fins 106 which are designed to effect efficient heat transfer from the warmer gas being circulated within the cabinet by a blower 108. The arrangement could be such that the high pressure liquid $CO_2$ from a storage vessel would be supplied through a line 110 to which all of the vertical tubes 102 are connected in parallel. Vapor exit pipes from the upper end of each tube 102 merge into a single line 112 that is connected to the suction side of the compressor. The tubes 102 effectively replace the holding tank 16. In this arrangement the gaseous atmosphere being circulated passes directly over the outer surface of the low-temperature coolant reservoir which is created in the plurality of large tubes 102 and then immediately over the product being frozen in the enclosure defined by the liner 104. If efficiently designed, this alternative system could eliminate a liquid pump, i.e., the pump 70, and could further effect a savings in capital cost by combining the holding tank and the heat-exchanger.

It has been found that the operation of a system such as illustrated in FIG. 1, utilizing a 3 horsepower freon condenser, which is the normal auxiliary size for a medium-size carbon dioxide storage vessel, plus a 3-horsepower carbon dioxide compressor, can produce and store refrigeration equivalent to that which would be available from a 50-horsepower mechanical refrigeration system that was sized for the fast freezing of the same amount of food product in the same time. Accordingly, the system has great utility in geographical regions where peak demand of electric power is either unavailable or high-priced, as well as for operations where fast freezing is desired but where the capital requirements of large-capacity mechanical equipment renders it too high-priced. Moreover, not only does the system afford the user the benefits of fast cryogenic freezing without substantial loss of the cryogen to the atmosphere, but freezing can be easily effected in a substantially pure carbon dioxide atmosphere by purging the cabinet of air prior to beginning the freezing cycle.

Figure 4:
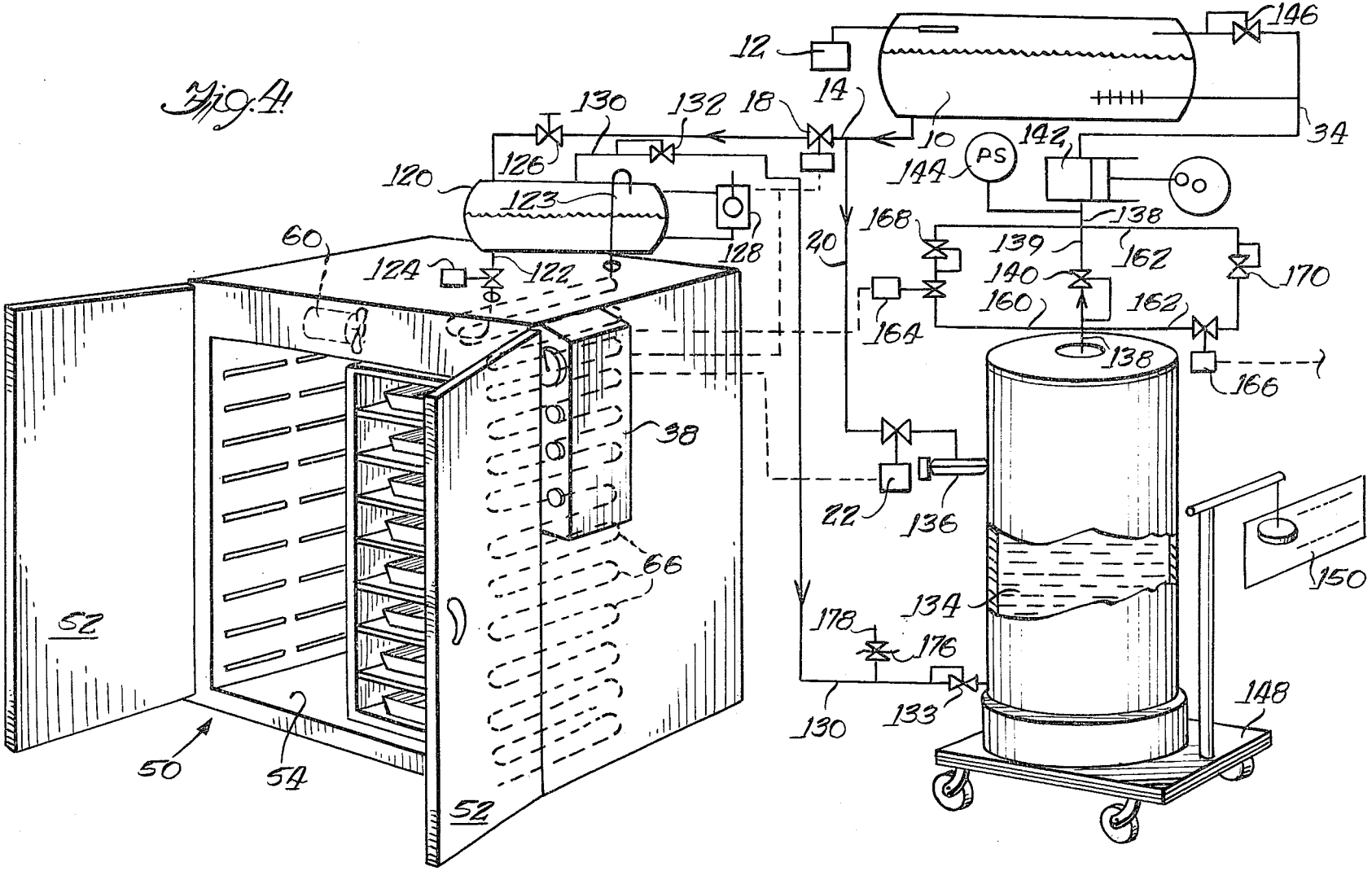
FIG. 4 is a view similar to FIG. 1 of yet another alternative embodiment.

In the embodiment depicted in FIG. 4, the same principle of storing refrigeration by phase change of carbon dioxide is utilized; however, the overall physical arrangement is different. The same refrigeration cabinet 50, with the heat-exchanger 66 and the motor-powered blower 60, is utilized, as described in detail hereinbefore with respect to FIG. 1. However, the liquid which is circulated through the heat-exchanger 66 in the FIG. 4 embodiment is supplied from an intermediate tank 120 via a line 122 containing a remotely-controlled valve 124. The exit end of the heat-exchanger 66 is connected to the vapor portion of the intermediate tank 120 by the line 123.

The intermediate tank 120 is supplied with liquid $CO_2$ from the main storage vessel 10 via the liquid feed line 14 and the remotely-operable solenoid valve 18. The liquid $CO_2$ storage vessel 10 will usually be at a pressure above 200 p.s.i.g., often in the range of about 300 p.s.i.g. The high pressure liquid expands at an adjustable expansion valve 126 to the lower pressure and lower temperature desired in the tank 120. A liquid level controller 128 connected to the tank 120 maintains a desired level of liquid $CO_2$ in the tank by opening the fill valve 18 whenever the liquid drops a predetermined amount below the desired level. A vapor line 130 leading from the tank 120 contains a back pressure regulator 132, which controls the pressure in the tank 120 and is usually set at a value between about 70 p.s.i.g. and about 90 p.s.i.g. The vapor line 130 is connected through another back pressure regulator 133 (set just above the triple point pressure) to the bottom of a thermally insulated holding tank 134.

A branch line 20 from the main liquid line 14 contains a remotely-operable valve 22 and leads to a carbon dioxide spray nozzle 136. The high-pressure liquid $CO_2$ flowing to the spray nozzle 136 expands through the nozzle orifice creating carbon dioxide vapor and either snow or very low pressure liquid depending upon the pressure in the holding tank 134. A vapor line 138 leads from the upper portion of the holding tank 134 and is branched to provide three parallel paths. The main branch 139 contains a pressure regulator 140 which is set to maintain a back pressure of at least about 80 p.s.i.a. in the holding tank. The vapor line 138 leads to a compressor 142 which is controlled by a pressure switch 144 that causes the compressor to run wherever there is some minimum vapor pressure available at the suction side, for example, at least about 60 p.s.i.a. The compressed vapor is returned to the storage vessel 10 through th return line 34 as described hereinbefore; however, when the vapor pressure in the vessel is low, a pressure-controlled valve 146 opens so it becomes immediately brought back up to a higher pressure when the compressor begins to run.

In the illustrated embodiment, the holding tank 134 is supported upon a scale or balance 148 to which a weight switch 150 is connected. The weight switch 150 has a pair of contact points and is connected to the control system 38. When a certain maximum weight is reached which indicates that the holding tank 134 is essentially full of liquid, the upper contact on the weight switch 150 signals the control system 38 to close the supply valve 22, thus halting supply of further carbon dioxide to the nozzle 136. The compressor 142 continues to run until all of the liquid $CO_2$ has been turned to snow. The snow in the holding tank 134 is then ready to condense the $CO_2$ vapor that will be created during freezing operations. Should the weight of carbon dioxide in the holding tank 134 fall below a certain desired amount, as for example if vapor is vented as hereinafter discussed, then the lower contact of the weight switch 150 causes the control system 38 to open the solenoid valve 22, supplying make-up liquid $CO_2$ to the nozzle 138 to provide additional snow in the tank.

Generally, the system will be sized so that the holding tank 134 will contain nearly enough carbon dioxide snow to condense most of the vapor which will be created during the next day's freezing operation, and the conversion of high pressure liquid $CO_2$ to fill the holding tank with snow is designed to be automatically carried out at a relatively slow rate throughout the night, thus requiring only a relatively small compressor and condenser. The remainder of the vapor which will be created is intended to be handled by the compressor 142 and condenser 12 which will be operating during freezing operations. The cross connections in the vapor line 138 are connected to two branch lines 160,162, each of which contains a solenoid-operated valve 164,166 and a pressure regulator 168,170, respectively.

When the control system 38 is actuated to begin snow-making to fill the tank 134, the valve 164 in the branch line 160 is opened, bringing into action the pressure regulator 168 which is set at 70 p.s.i.a. Thus, as the liquid $CO_2$ is sprayed into the tank 134 through the nozzle 136, the compressor 142 works to try to hold the pressure between about 70 and 75 p.s.i.a. so that snow will be created. The nozzle 136 may be sized to expand liquid at a rate at which the compressor 142 can keep pace; however, it can be allowed to enter at a faster rate and be transformed to snow later as the compressor reduces the pressure in the holding tank. Once the holding tank is full with snow so that the compressor 142 ceases operation, the valve 164 is closed, so that the pressure regulator 140 then takes over, which is set at about 80 p.s.i.a. which is above the triple point.

After the product to be cooled or frozen has been loaded into the cabinet 50, the doors 52 are closed, and the control system 38 is actuated to start the cooling process. The solenoid valve 124 is opened allowing cold liquid $CO_2$ to flow by gravity to the heat-exchange coil 66. When only cooling, chilling or slow freezing is desired, achieving a temperature of about −30° F. is usually adequate; however, for cryogenic-type freezing, temperatures of −50° F. or below are desired in the enclosure 50. If the tank 120 is maintained at a pressure of about 90 p.s.i.a. (75 p.s.i.g.), the liquid in the heat-exchanger 66 will be at about −62° F. and will be fully capable of lowering the temperature of the atmosphere in the enclosure 54 to about −50° F. or lower. The circulation of the atmosphere past the heat-exchanger 66 by the fan causes the liquid $CO_2$ to vaporize, and the vapor exits from the opposite end of the heat-exchanger and is returned through the vapor line 123 to the intermediate tank 120. The $CO_2$ vapor which is created in the heat-exchanger 66 flows from the tank 120 through the line 130, past the pressure regulators 132,133, into the bottom of the holding tank 134 which is maintained at a lower pressure by the compressor. Additional liquid $CO_2$ is supplied to the tank 120 through the fill valve 18 as called for by the liquid level controller 128.

As the vapor enters the bottom of the holding tank 134 through the line 130, it causes the $CO_2$ snow to melt and forms slush with a gradually decreasing percentage of solids. In order to give the compressor 142 a head-start when freezing operations are begun, as soon as the control system opens the valve 124 to start gravity flow to the heat-exchanger 66, the normally closed, solenoid valve 166 in the vapor line branch 162 is opened. The pressure regulator 170 in this line is set to maintain a downstream pressure of 65 p.s.i.a., and thus vapor immediately passes through the regulator 170, actuating the pressure switch 144 and starting the compressor 142. This arrangement gives the compressor 142 a slight head-start in preparing for the vapor which will soon be forthcoming by allowing the compressor to begin to remove vapor from the holding tank 134. The valve 166 may be closed at the end of the freezing cycle or during a period when slush-making is in progress.

As a result, as freezing of the product in the refrigeration chamber 50 takes place, $CO_2$ vapor is continuously being created, which gradually melts the $CO_2$ snow in the holding tank, first forming slush and then melting the solid portion of the slush to liquid as the vapor continues to be condensed on its travel upward. The compressor 142 is constantly operating to remove $CO_2$ vapor from the tank, compress it, and return it to the storage vessel 10 for condensation. Should the compressor 142 be unable to keep up and should all of the slush turn to liquid, the incoming vapor will bubble through the liquid and increase the pressure in the tank 134 and thus in the incoming vapor line 130. To prevent the pressure from rising above about 85 p.s.i.a., a pressure-reading relief valve 176 is provided in the vapor line 130 which leads to a vent line 178. The relief valve 176 vents the vapor line 130 should the pressure in the holding tank 134 rise above 85 p.s.i.a. Thus, even if the compressor should be momentarily unable to keep pace with the refrigeration requirements of the freezer near the end of an unusually heavy day's freezing operations, the venting of the line 130 leading from the tank 120 assures a pressure differential will be maintained so that the flow of cryogen through the heat-exchanger 66 is not slowed.

The physical arrangement illustrated efficiently provides relatively large amounts of cryogenic cooling by the accumulation of snow in the suitably insulated holding tank 134, which can be accomplished automatically overnight. The system can function effectively using a compressor 142 driven by a 3 horsepower motor and making use of a standard storage vessel condenser.

Figure 5:
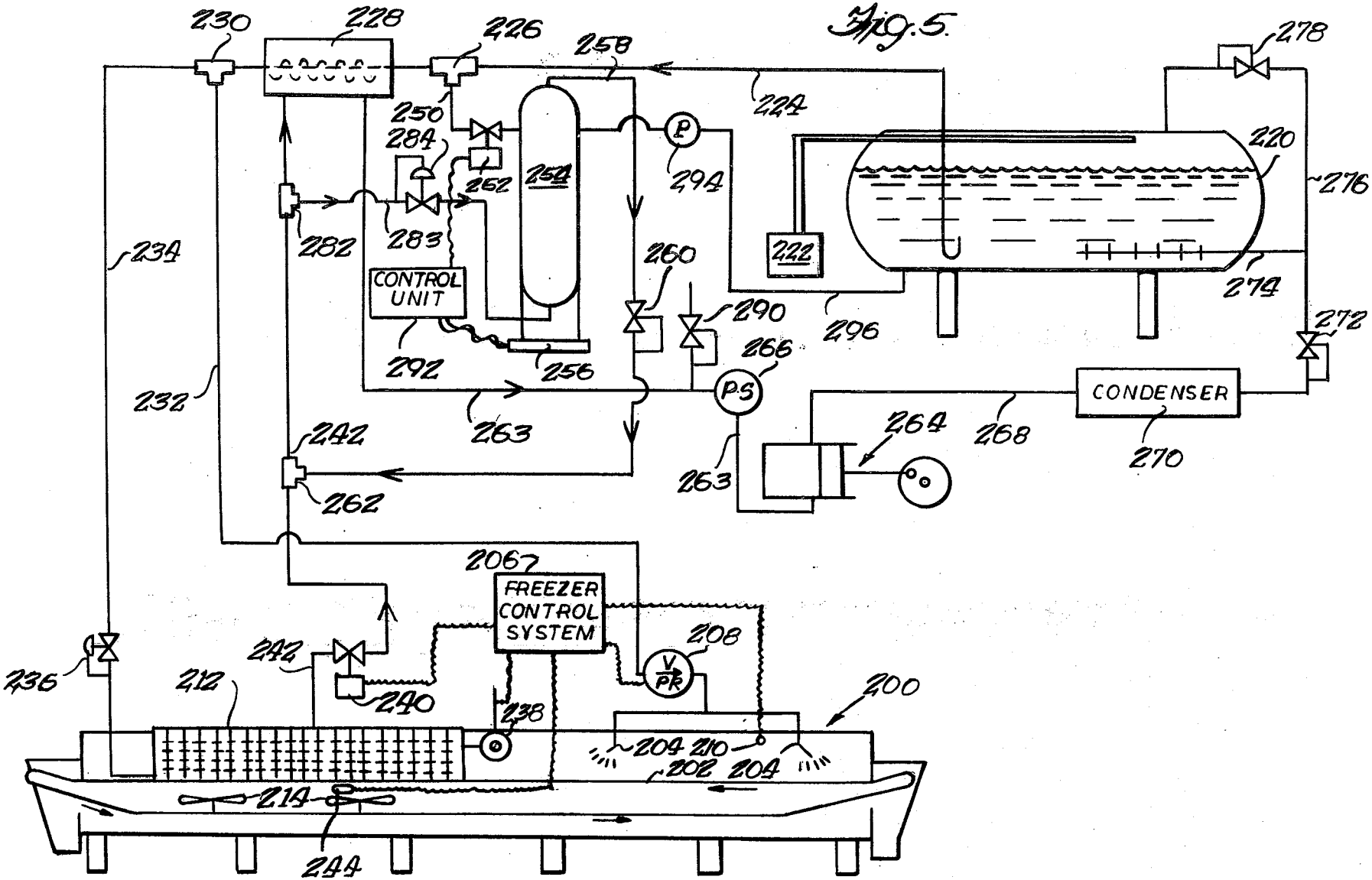
FIG. 5 is a view of another carbon dioxide cooling system embodying various features of the invention.

In the embodiment depicted in FIG. 5, the general principle of storing refrigeration by phase change of carbon dioxide is utilized; however, this particular system utilizes the cryogenic temperatures available from carbon dioxide to cool or freeze material being continuously carried through an elongated, insulated chamber. Illustrated is a food freezer 200 which includes an endless conveyor belt 202 that is designed to carry product to be frozen from an entrance at the right-hand end to a discharge exit at the left-hand end. Disposed above the belt near the entrance are a plurality of snow nozzles 204 designed to blanket the belt and the material being carried thereupon with a layer of high velocity carbon dioxide snow.

The snow-making system can be of the type disclosed in my earlier U.S. Pat. No. 3,815,377, issued June 11, 1974, the disclosure of which is incorporated herein by reference. For purposes of the present application, it is adequate to indicate that there is a freezer control system 206 which controls an adjustable pressure-regulating valve 208 to produce the amount of snowing desired, depending upon the temperature within the freezer 200 sensed by a thermocouple 210. The left-hand section of the freezer 200 includes a heat exchanger 212 of any desired style and is sometimes referred to as a through-freeze section.

In operation, the product is quickly blanketed with snow to create a frozen crust that prevents the escape of fluids, and then freezing of the remainder of the crusted product occurs in the through-freeze section. The heat exchanger 212 functions as an evaporator and a plurality of fans 214 are associated with it which maintain a circulation of the cold atmosphere about the product on the belt 202, which is preferably of the porous variety so that all surfaces of the product are exposed to the vapor. The snow-making nozzles 204 create carbon dioxide vapor along with the snow, and the subliming carbon dioxide snow creates additional carbon dioxide vapor so that the food freezer 200 will be quickly filled with inert carbon dioxide vapor, excluding moisture-containing air therefrom. Accordingly, the fans 214 in the through-freeze section circulate the carbon dioxide vapor through the heat-exchanger 212 and thence against the surfaces of the product being frozen, without significant moisture collection on the exposed surfaces of heat-exchanger 212. The vapor from the snow nozzles and from the subliming snow is expended and appropriately exhausted from the premises, with no attempt being made to recover it. However, the remainder of the carbon dioxide which vaporizes in the evaporator 212 is recoverable in the illustrated system.

A main liquid carbon dioxide storage vessel 220 is employed which is designed to store high pressure liquid $CO_2$ at about 300 p.s.i.g. and 0° F. A freon condenser 222 of suitable capacity is associated with the vessel and operates as needed to condense the vapor in the vessel to maintain the desired pressure limit. A liquid supply line 224 from the vessel leads to a tee 226, and one branch of the tee leads to a heat-exchanger 228 and then to a second tee connection 230. One line 232 from the second tee connection 230 leads to the pressure regulating valve 208 in the snow-making system, and the other leg of the tee 230 connects to a line 234 which includes a pressure regulator 236 and connects to the inlet end of the evaporator 212 within the food freezer.

The evaporator 212 includes a liquid level control monitor 238 which is connected to the control system 206 and to a solenoid-operated valve 240 which is located in a vapor return line 242 connected to the top of the evaporator. The function of the liquid level control 238 is to prevent the evaporator 212 from completely filling with liquid $CO_2$, as it is desirable that boiling conditions be maintained within the evaporator so that only vapor flows through the line 242. Accordingly, should the liquid level monitor 238 indicate the rise of liquid to a level near the top, it signals the control system to close the valve 240 to prevent the further infeed of liquid $CO_2$ until such time as the level decreases. During this period of time, boiling continues and causes the liquid $CO_2$ to simply backup in the feed line 234 as the pressure increases, until the liquid falls below the desired level. The control system 206 also includes a sensor 244 that senses the temperature in the thorough-freeze section of the freezer, and the control system will close the valve 240 should too cold a temperature be detected. The vapor return line 242 leads to the heat-exchanger 228 through which the incoming high pressure liquid passes, and thus advantage is taken of the cooling capacity of the cold vapor to subcool the incoming liquid before the vapor is condensed.

The other leg of the first tee 226 connects to a line 250 which leads to a remote-controlled valve 252 and then to a holding chamber 254 which is supported upon a load cell 256. A vapor outlet line 258 leads from the top of the holding chamber 254 through a pressure regulator 260, usually set at 72 p.s.i.a., to a tee 262 in the vapor line 242 upstream of the heat-exchanger 228. The vapor exits from the heat-exchanger 228 via a line 263 that leads to a compressor 264, the operation of which is controlled by a pressure switch 266. The compressor outlet line 268 leads through an auxiliary condenser 270 through a pressure regulator 272 and then to a vapor return line 274 which enters the bottom of the main storage vessel 220 so that the liquid and vapor bubble into the high pressure liquid reservoir. A branch vapor line 276 is connected through a pressure regulator 278 to the vapor portion of the storage vessel 220. Regulator 272 is set to hold an efficient pressure in the condenser 270, irrespective of the pressure in the vessel 220, which varies widely due to filling and other conditions. The pressure regulator 278 in the branch line opens whenever it reads a pressure less than at which the freon condenser 222 is set to turn off, so that when this condition exists and liquid and vapor are again returned to the storage vessel by the compressor, the pressure in the head space above the liquid immediately rises to activate the freon condenser 222 and to maintain a stable feed pressure on the system, including the snow nozzles 204.

Another tee connection 282 in the vapor line 242 leading to the heat-exchanger 228 provides a branch line 283 which contains a pressure regulator 284 and connects to the bottom of the holding chamber 254, and the pressure regulator 284 will usually be set at about 85 p.s.i.a. The pressure switch 266 which controls the compressor may be set to turn off at about 70 p.s.i.a. Accordingly, when vapor is being created by boiling in the evaporator 212 and is flowing through the exit line 263 from the heat-exchanger 228, the pressure switch 266 will turn on the compressor 264 to recover that vapor. However, when a peak load occurs and the compressor is unable to handle all of the vapor being created, the pressure in the vapor return line 242 rises, causing the pressure regulator 284 to open, thus providing a path through the branch line 283 to the holding chamber 254. A portion of the vapor in the return line 242 accordingly flows into the holding chamber 254 where it is condensed so long as there is snow present. Should an unusually long peak load condition exist, a relief valve 290 in the line 263 will open to vent the excess pressure as needed to maintain the pressure at the desired maximum limit, for example, 80 p.s.i.g. so that liquid will continue to flow to the evaporator 212 to maintain the operation of the freezer.

On the other hand, when a "valley" or very light load occurs so that the compressor 264 is able to handle more than the amount of vapor being created in the evaporator 212, the pressure in vapor lines 263 and 242 drops to below the set point of regulator 260, causing it to open, and the compressor draws vapor from the holding chamber 254 and begins to replenish the snow content of the reservoir. Thus, the holding chamber 254, suitably controlled by the pressure regulators 260 and 284, serves as a device to even out the recovery flow to the compressor 264 of vapor created in evaporator 212.

A refrigeration control unit 292 monitors the readings from the load cell 256 and controls the filling of the holding chamber 254 via the remote-controlled valve 252. The control unit 292 is set to initially fill the chamber 254 with liquid $CO_2$ until a certain weight is reached. The valve 252 is then closed to allow the compressor 264 to convert the liquid to snow. As the pool of liquid is turned to snow, the weight of the reservoir within the holding chamber 254 decreases. When the load cell 256 monitors a drop in weight below a predetermined point, the valve 252 may be opened again by the control unit 292 to allow an additional quantity of liquid to be fed to the chamber, for example, on a timed flow basis. After the valve 252 is again closed and the pressure lowered by the compressor 264 to turn this quantity of liquid $CO_2$ to snow, the steps can be repeated. In this manner, a 2-, 3- or 4-stage filling of the chamber 254 can be carried out so as to obtain a reservoir of snow that fairly well fills the chamber 254.

However, when vapor is condensed by such a fairly full tank of $CO_2$ snow, the volume of slush within the chamber 254 continuously increases as liquid is formed by the melting snow and condensing vapor. In such an instance, an increase in the weight of the reservoir above a desirable maximum is monitored by the load cell 256, and the control unit 292 actuates a pump 294 which withdraws liquid $CO_2$ from a region near the top of the chamber 254 and returns it to the main liquid $CO_2$ storage vessel 220 through a line 296. When the weight of the reservoir is appropriately reduced, the operation of the pump 294 is suspended by the control unit 292 until the desired maximum weight should again be reached. In this manner, the effective volume of the holding chamber 254 can be increased over the amount of $CO_2$ which it could otherwise handle, if its capacity were limited to an amount of snow corresponding to its liquid capacity. For example, a 10,000 gallon holding chamber operated without a pump 294, can accept and condense enough vapor to provide over 4,000,000 BTU's of cooling to the freezer 200. If automatic pump-out protection via the pump 294 is incorporated, over 6,000,000 BTU's of cooling can be provided by the same size holding chamber.

Although the invention has been illustrated with regard to certain particular embodiments, it should be understood that changes and modifications as would be obvious to one having the ordinary skill in the art may be made without departing from the scope of the invention which is defined by the claims appended hereto. For example, similar systems can be used in storage installations to maintain cold temperatures for material already chilled or frozen, and cooling is used in this application to encompass such an arrangement. These refrigeration systems are considered advantageous for achieving cooling or freezing temperatures of 0° F. and below, and they are considered to be particularly valuable because they can provide cryogenic freezing temperatures, e.g., −50° F. and below, without expenditure of cryogen while minimizing installation cost. Moreover, the inventions are useful not only in substantially permanent installations, but also in connection with portable refrigeration units or cryogen supply units where coupling is effected at time of recharging or slush-making.

Various features of the invention are set forth in the claims which follow.

What is claimed is:

1. A method for cooling material using liquid $CO_2$, which method comprises supplying high pressure liquid $CO_2$ to a holding chamber from a liquid $CO_2$ storage vessel system, reducing the pressure of said liquid $CO_2$ at said holding chamber to below 75 psia to create $CO_2$ vapor and $CO_2$ snow thereby forming a low-temperature coolant reservoir in said holding chamber, removing said $CO_2$ vapor from said chamber, compressing said removed $CO_2$ vapor and condensing same, supplying the material being cooled to a refrigeration enclosure having heat-transfer means therein, lowering the temperature in said refrigeration enclosure to about 0° F. or below by circulating a gaseous atmosphere within said enclosure past said heat-transfer means which is cooled by $CO_2$, and removing heat from said heat-transfer means by interchanging same with the latent heat of said solid $CO_2$ snow in said holding chamber and thereby melting said snow.

2. A method in accordance with claim 1 wherein not all of said liquid $CO_2$ is transformed to solid $CO_2$, wherein liquid $CO_2$ is separated from said solid $CO_2$ in said chamber and pumped to said heat-transfer means and wherein the vapor created therein is returned to said holding chamber.

3. A method in accordance with claim 1 wherein substantially all of said liquid $CO_2$ is transformed to $CO_2$ snow, wherein additional liquid $CO_2$ is supplied to said chamber to create a slush mixture with said snow, wherein liquid $CO_2$ from said holding chamber is supplied to said heat-transfer means wherein vaporization occurs, and wherein said $CO_2$ vapor from said heat-transfer means is returned to said chamber and is condensed by melting the snow portion of said $CO_2$ slush.

4. A method of cooling in accordance with claim 3 wherein liquid $CO_2$ is physically separated from said slush within said chamber and wherein said separated liquid is withdrawn therefrom and pumped through said heat-transfer means.

5. A method in accordance with claim 1 wherein said liquid $CO_2$ is supplied from a storage vessel maintained at a pressure of at least about 200 psig, wherein said $CO_2$ vapor is automatically removed from said chamber following said supplying to lower the pressure in said chamber to a value not greater than about 75 psia to transform substantially all said liquid $CO_2$ to snow and wherein additional liquid $CO_2$ is supplied to said chamber to form slush with said snow.

6. A method in accordance with claim 1 wherein said low temperature coolant reservoir is created within heat-transfer means disposed in association with said refrigeration enclosure and wherein said gaseous atmosphere is circulated past said heat-transfer means.

7. A method in accordance with claim 1 wherein an auxiliary stream of heat-transfer fluid is caused to flow in heat-transfer relationship with said coolant reservoir and in heat-transfer relationship with said circulating gas in said refrigeration enclosure.

8. A method for providing stored carbon dioxide refrigeration for processes using liquid $CO_2$ for cooling purposes, which method comprises flowing liquid $CO_2$ to a holding chamber from a liquid $CO_2$ storage vessel system, reducing the pressure of said liquid $CO_2$ at said holding chamber to below 75 psia to create $CO_2$ vapor and $CO_2$ snow thereby forming a low-temperature coolant reservoir in said holding chamber, removing said $CO_2$ vapor from said holding chamber, compressing said removed $CO_2$ vapor and returning same to said storage vessel system, supplying additional liquid from said storage vessel system for cooling purposes, and recovering $CO_2$ vapor created by said supplied liquid $CO_2$ and injecting said recovered vapor into said holding chamber so as to condense said injected vapor by melting said solid $CO_2$ snow.

9. Apparatus for cooling material using $CO_2$ refrigeration, which apparatus comprises a holding chamber, a $CO_2$ storage vessel, means for supplying liquid $CO_2$ from said vessel to said chamber, means associated with said chamber for reducing the pressure of liquid $CO_2$ in said chamber and forming solid $CO_2$ to create a low-temperature coolant reservoir in said chamber, a compressor for removing $CO_2$ vapor from said chamber and returning same to said storage vessel, a refrigeration enclosure into which the material to be cooled is supplied, means for creating a circulation of the atmosphere in said refrigeration enclosure, means for lowering the temperature within said enclosure to at least about 0° F. by heat-exchange with said coolant reservoir and means for automatically venting $CO_2$ vapor from said chamber if the pressure therein rises above a predetermined level while said gaseous atmosphere is being circulated in said enclosure.

10. Apparatus in accordance with claim 9 wherein control means connected to said pressure-reducing means causes substantially all of said liquid $CO_2$ to be transformed to snow, wherein means is provided for supplying additional liquid $CO_2$ to said chamber to create slush therein, wherein means is provided for physically separating liquid $CO_2$ from said slush, and wherein means is provided for withdrawing said separated liquid from said chamber and pumping same through heat-transfer means associated with said refrigeration enclosure.

11. Apparatus in accordance with claim 9 wherein heat-transfer means is disposed in association with said refrigeration enclosure, and wherein said low temperature coolant reservoir is created within said heat-transfer means.

12. Apparatus in accordance with claim 9 wherein first heat-exchange means is provided in contact with said coolant reservoir and wherein second heat-exchange means is provided in contact with said circulating gas in said refrigeration enclosure and wherein means is provided for pumping an auxiliary stream of heat-transfer liquid from said first heat-exchange means to said second heat-exchange means and back to said first heat-exchange means.

13. Apparatus in accordance with claim 9 wherein means is provided for controlling said pressure-reducing means so that not all of said liquid $CO_2$ is transformed to solid $CO_2$, wherein liquid $CO_2$ is separated from said solid $CO_2$ and pumped to said refrigeration enclosure and wherein the vapor created therein is returned to said holding chamber.

14. Apparatus for supplying a refrigeration system with liquid $CO_2$ at a temperature of about −50° F. or below, which apparatus comprises a liquid $CO_2$ storage vessel system, a holding chamber, means for supplying high pressure liquid $CO_2$ from said liquid $CO_2$ storage vessel system to said holding chamber, means for reducing the pressure of the liquid $CO_2$ at said holding chamber to create $CO_2$ vapor and $CO_2$ snow and thereby forming a low-temperature coolant reservoir in said holding chamber, vapor outlet means for removing $CO_2$ vapor from said chamber to maintain the pressure therein at about 75 psia or below, compressor means connected to said vapor outlet means for compressing the removed $CO_2$ vapor and returning same to said storage vessel system, a refrigeration system, means for supplying additional liquid $CO_2$ from said $CO_2$ storage vessel system to said refrigeration system and for reducing the pressure of said additional liquid $CO_2$ to below about 125 psia to create a body of liquid $CO_2$ for refrigeration use, means for releasing intermediate pressure $CO_2$ vapor from said refrigeration system, and means for transferring said released intermediate-pressure $CO_2$ vapor to said holding chamber to condense same by melting said snow.

15. Apparatus in accordance with claim 14 wherein weight switch means is associated with said holding chamber, wherein a control system is connected to said weight switch, wherein a remote-controlled valve and back pressure regulation means are provided between said holding chamber vapor outlet and said main compressing means, said back pressure regulator means being set below the triple point and wherein said control system is adapted to open said remote-controlled valve after a predetermined weight is achieved in said holding chamber.

16. Apparatus for cooling material with $CO_2$, which apparatus comprises a liquid $CO_2$ storage vessel system, a holding chamber, means for supplying high pressure liquid $CO_2$ from said liquid $CO_2$ storage vessel system to said holding chamber, means for reducing the pressure of the liquid $CO_2$ at said holding chamber to below 75 psia to create $CO_2$ vapor and $CO_2$ snow and thereby forming a low-temperature coolant reservoir in said holding chamber, vapor outlet means for removing $CO_2$ vapor from said chamber, compressor means connected to said vapor outlet means for compressing the removed $CO_2$ vapor and returning same to said storage vessel system, a refrigeration system, means for supplying additional liquid $CO_2$ from said $CO_2$ storage vessel system to said refrigeration system and for vaporizing said additional liquid $CO_2$ to cool said material, and means for transferring said $CO_2$ vapor from said additional vaporized liquid to said holding chamber to condense same by melting said snow.

17. Apparatus in accordance with claim 16 wherein said additional liquid is supplied to heat-exchange means in a refrigeration enclosure.

18. Apparatus in accordance with claim 17 wherein liquid $CO_2$ from said storage vessel system is also sprayed into said refrigeration enclosure to deposit snow on the material being cooled and to create a $CO_2$ atmosphere therein and wherein means is provided for circulating said $CO_2$ atmosphere past said heat-exchange means and said material.

19. Apparatus in accordance with claim 17 wherein first conduit means is provided for connecting the outlet from said heat-exchange means to said compressor means, wherein second conduit means is provided for interconnecting said first conduit means and a lower location in said holding chamber, and wherein valve means is provided in said second conduit means which is designed to open whenever the pressure in said first conduit means exceeds a predetermined amount.

20. A method of cooling material using stored cryogenic refrigeration, which method comprises supplying liquid cryogen to a chamber, controlling the temperature and pressure of said cryogen in said chamber so that it is at the triple point whereat slush and vapor exist in equilibrium, removing cryogen vapor from said chamber to increase the percentage of solid cryogen in said chamber and create a low temperature coolant reservoir and recovering said removed cryogen vapor, supplying the material to be cooled in association with heat-exchange means, supplying liquid cryogen to said heat-exchange means to cool the material to about 0° F. or below by vaporization of liquid cryogen in said heat-exchange means, and transferring cryogen vapor produced in said heat-exchange means to said chamber where it is condensed by melting said solid cryogen in said chamber.

21. A method in accordance with claim 20 wherein said cryogen is $CO_2$.

22. A method in accordance with claim 21 wherein material being cooled is supplied to a refrigeration enclosure which includes said heat-exchange means in one section and snow-making means in another section, wherein liquid $CO_2$ is supplied to both said heat-exchange means and said snow-making means, and wherein the vapor created in said refrigeration enclosure by said snow-making means is circulated past said heat-exchange means.

23. Apparatus for cooling material using cryogenic refrigeration, which apparatus comprises a chamber, means for supplying liquid cryogen to said chamber, means associated with said chamber for reducing the pressure in said chamber below the triple point and forming a substantial amount of solid cryogen to create a low-temperature coolant reservoir in said chamber, a compressor for removing cryogen vapor from said chamber, means for condensing and recovering said compressed vapor, heat-transfer means associated with the material to be cooled, means for supplying liquid cryogen to said heat-transfer means to cool said material by creating cryogen vapor, and means removing said vapor from said heat-transfer means and transferring said vapor to said chamber where it condenses by melting solid cryogen within said coolant reservoir.

24. Apparatus in accordance with claim 23 wherein said vapor removal means includes first conduit means which connects an outlet from said heat-transfer means to said compressor, second conduit means which interconnect said first conduit means and a lower location in said chamber and valve means in said second conduit means which opens whenever the pressure in said first conduit means exceeds a predetermined amount.

* * * * *